US009383144B2

(12) United States Patent
Stoll et al.

(10) Patent No.: US 9,383,144 B2
(45) Date of Patent: Jul. 5, 2016

(54) HEAT TRANSFER UNIT

(75) Inventors: Reinhard Stoll, Metzingen (DE); Alfredo Ghidini, Vescovato (IT); Stefan Müller-Lufft, Leonberg (DE); Stefan Laux, Starzach (DE)

(73) Assignee: Modine Manufacturing Company, Racine, WI (US)

( * ) Notice: Subject to any disclaimer, the term of this patent is extended or adjusted under 35 U.S.C. 154(b) by 602 days.

(21) Appl. No.: 13/322,302

(22) PCT Filed: May 3, 2010

(86) PCT No.: PCT/EP2010/002679
§ 371 (c)(1),
(2), (4) Date: Nov. 23, 2011

(87) PCT Pub. No.: WO2010/136108
PCT Pub. Date: Dec. 2, 2010

(65) Prior Publication Data

US 2012/0061060 A1 Mar. 15, 2012

(30) Foreign Application Priority Data

May 27, 2009 (DE) ..... 10 2009 022 919
Oct. 21, 2009 (DE) ..... 10 2009 050 016

(51) Int. Cl.
*F01P 11/08* (2006.01)
*F28D 9/00* (2006.01)
(Continued)

(52) U.S. Cl.
CPC ..... *F28D 9/005* (2013.01); *F01M 5/002* (2013.01); *F28F 9/0246* (2013.01); *F28D 2021/0089* (2013.01); *F28F 2250/06* (2013.01); *F28F 2280/06* (2013.01)

(58) Field of Classification Search
CPC ..... F28F 2250/04; F28F 2009/22; F28F 2009/222; F28F 3/08; F28F 3/12; F28F 2250/06; F28F 27/02; F28F 2280/06; F28D 9/005; F28D 2021/0089; F01M 5/002; F01M 5/004; F01M 5/005; F01M 5/007; F01M 2011/033; F01P 11/08
USPC ..... 165/165, 166, 167, 170, 916, 299, 51, 165/74, 103; 123/196 AB, 41.33, 196 R; 184/104.1, 104.2, 104.3, 106
See application file for complete search history.

(56) References Cited

U.S. PATENT DOCUMENTS 2,070,092 A 2/1937 Ramsaur
2,222,721 A * 11/1940 Ramsaur et al. ..... 165/157
(Continued)

FOREIGN PATENT DOCUMENTS

CA 2120426 10/1994
CN 1295473 5/2001
(Continued)

OTHER PUBLICATIONS

Second Office Action from the State Intellectual Property Office of the People's Republic of China for Application No. 201080023519.1 dated Oct. 28, 2013 (8 pages).
(Continued)

*Primary Examiner* — Judy Swann
*Assistant Examiner* — John Higgins
(74) *Attorney, Agent, or Firm* — Michael Best & Friedrich LLP

(57) ABSTRACT

A heat exchanger unit that includes a plurality of first heat exchanger ducts formed by a plurality of plates configured for a first flow of a coolant, a plurality of second heat exchanger ducts formed by the plurality of plates configured for a second flow to be cooled by the first flow, a first inlet for the first flow, a first outlet for the first flow, a first inlet for the second flow, and a second outlet for the second flow. The heat exchanger unit further includes an inlet chamber for the first flow from which a partial flow of the first flow is branched off, conducted through the plurality of first heat exchanger ducts and circulated within the heat exchanger unit to the first outlet.

18 Claims, 9 Drawing Sheets

(51) Int. Cl.

| | |
|---|---|
| ***F01M 5/00*** | (2006.01) |
| ***F28F 9/02*** | (2006.01) |
| *F28D 21/00* | (2006.01) |

(56) References Cited

U.S. PATENT DOCUMENTS

| | | | | |
|---|---|---|---|---|
| 4,423,708 | A * | 1/1984 | Sweetland | 123/196 AB |
| 5,558,154 | A * | 9/1996 | Lefeber | 165/51 |
| 5,575,329 | A * | 11/1996 | So et al. | 165/167 |
| 5,758,608 | A * | 6/1998 | Berger et al. | 123/41.33 |
| 5,896,834 | A * | 4/1999 | Gruner | 123/41.33 |
| 5,964,283 | A * | 10/1999 | Pavlin | 165/167 |
| 6,026,804 | A * | 2/2000 | Schardt et al. | 126/344 |
| 6,263,960 | B1 * | 7/2001 | Yamanaka et al. | 165/119 |
| 6,298,910 | B1 | 10/2001 | Komoda et al. | |
| 6,360,702 | B1 * | 3/2002 | Osada | 123/41.31 |
| 7,377,308 | B2 * | 5/2008 | Ware | 165/167 |
| 2004/0112579 | A1 * | 6/2004 | Strahle | 165/166 |

FOREIGN PATENT DOCUMENTS

| | | |
|---|---|---|
| CN | 1884951 | 12/2006 |
| DE | 19654365 | 6/1998 |
| DE | 10048212 | 4/2001 |
| DE | 10313685 | 10/2003 |
| DE | 202005017975 | 1/2007 |
| DE | 102006016839 | 10/2007 |
| DE | 102007052706 | 5/2009 |
| DE | 102009022919 | 12/2010 |
| EP | 0787929 | 8/1997 |
| EP | 0916816 | 5/1999 |
| EP | 1876406 | 1/2008 |
| JP | 2004346916 | 12/2004 |
| WO | 9429659 | 12/1994 |
| WO | 9519536 | 7/1995 |
| WO | 02/16852 | 2/2002 |
| WO | 03080233 | 10/2003 |
| WO | 2010136108 | 12/2010 |

OTHER PUBLICATIONS

First Office Action from the State Intellectual Property Office of the People's Republic of China for Application No. 201080023519.1 dated Apr. 2, 2013 (5 pages—English translation).

Office Action from the State Intellectual Property Office of the People's Republic of China for Application No. 201080023519.1 dated Apr. 22, 2014 (9 pages).

PCT/EP2010/002679 International Search Report dated May 12, 2011, 4 pages.

* cited by examiner

B-B

A-A

AB - AB

HEAT TRANSFER UNIT

CROSS REFERENCE TO RELATED APPLICATIONS

This patent application is a national stage filing under 35 U.S.C. 371 of International Application No. PCT/EP/2010/002679 filed May 3, 2010, which claims priority to German Patent Application Nos. DE 10 2009 022 919.1 filed May 27, 2009 and DE 10 2009 050 016.2 filed Oct. 21, 2009, the entire contents of all of which are herein incorporated by reference.

BACKGROUND

The invention relates to a heat exchanger unit which has heat exchanger ducts, formed by plates, for a coolant flow and for a flow to be cooled or to be temperature-controlled, and which is provided with corresponding inlets and outlets for the flows.

Heat exchanger units of said type are known for example from EP 916 816 B1. Said heat exchanger unit was used as an oil cooler in a motor vehicle. The coolant is conventionally the cooling liquid of the motor vehicle engine. From the coolant flow which cools the engine, a partial flow is branched off and used for oil cooling, then the partial flow is added to the coolant flow again after the exchange of heat with the oil has taken place, before then being recooled in a radiator. The branching of the partial flow is realized conventionally by means of corresponding valves or the like. The branched partial flow is often transported to the heat exchanger and back by means of lines.

EP 653 043B discloses another compact, housingless heat exchanger unit which is constructed from plates and which has an adapter plate. A coolant flow which has previously been branched off flows through said heat exchanger unit.

It is also known for coolant flows of different temperature to be mixed and passed through the heat exchanger in order to always be able to provide an optimum resulting oil temperature (EP 787 929 B1, U.S. Pat. No. 2,070,092).

SUMMARY

It is an object of the invention to provide a compact, low cost heat exchanger unit to which an extremely large volume flow can be conducted.

The unit according to some embodiments of the invention may either have a housing or be of housingless construction.

In one embodiment, the heat exchanger unit is provided with an inlet chamber for a first flow, from which inlet chamber a partial flow can be branched off, conducted or circulated through the associated heat exchanger ducts and recirculated into or combined with the first flow upstream of the outlet, that is to say within the unit. To obtain a corresponding heat exchange action, it has been found that the partial flow should amount to approximately 20 to 80 percent of the coolant flow. According to a further distinguishing feature, the inlet chamber is arranged to the side of the plates or to the side of the heat exchanger ducts formed from said plates. This, however, does not necessarily apply to the outlet chamber.

The described construction constitutes a compact, low cost unit because it can be connected directly to a main coolant line, for example, and can branch off the required coolant flow from the main coolant flow without complex circuit arrangements. The partial flow, after the exchange of heat has taken place, is circulated into the main coolant flow still within the heat exchanger unit, before then being supplied, for example, to a radiator for cooling.

The present invention differs from the oil cooler according to DE 196 54 365 A1, which shows and describes a heat exchanger with bypasses. The heat exchanger according to some embodiments of the invention forms a unit into which is introduced a flow (for example a coolant flow, specifically the entire coolant flow which flows for example through an internal combustion engine) significantly larger than the partial flow which ultimately flows through the ducts of the heat exchanger itself. In DE 196 54 365 A1, the entire flow introduced into the heat exchanger, which there is already a coolant partial flow, flows through the ducts, including the bypasses.

An aspect of the housingless construction provides that a plate stack is arranged in a chamber and the first flow flows around, at least partially flows around, or washes around the plate stack in the chamber, and then merges again with the partial flow which has flowed through the associated heat exchanger ducts. The chamber can be an engine casing chamber into which the plate stack of the heat exchanger unit is inserted. Here, the engine casing chamber is closed off by means of an orifice plate and/or mounting plate or adapter plate fastened to the plate stack. Thermodynamic advantages can be obtained as a result of the fact that the first flow flows around or washes around the plate stack within said chamber.

Furthermore, these and other features which may be of importance depending on the circumstances, and the effects of said features, will emerge from the following description of exemplary embodiments on the basis of the appended drawings.

DETAILED DESCRIPTION

Figures 1A, 1B:
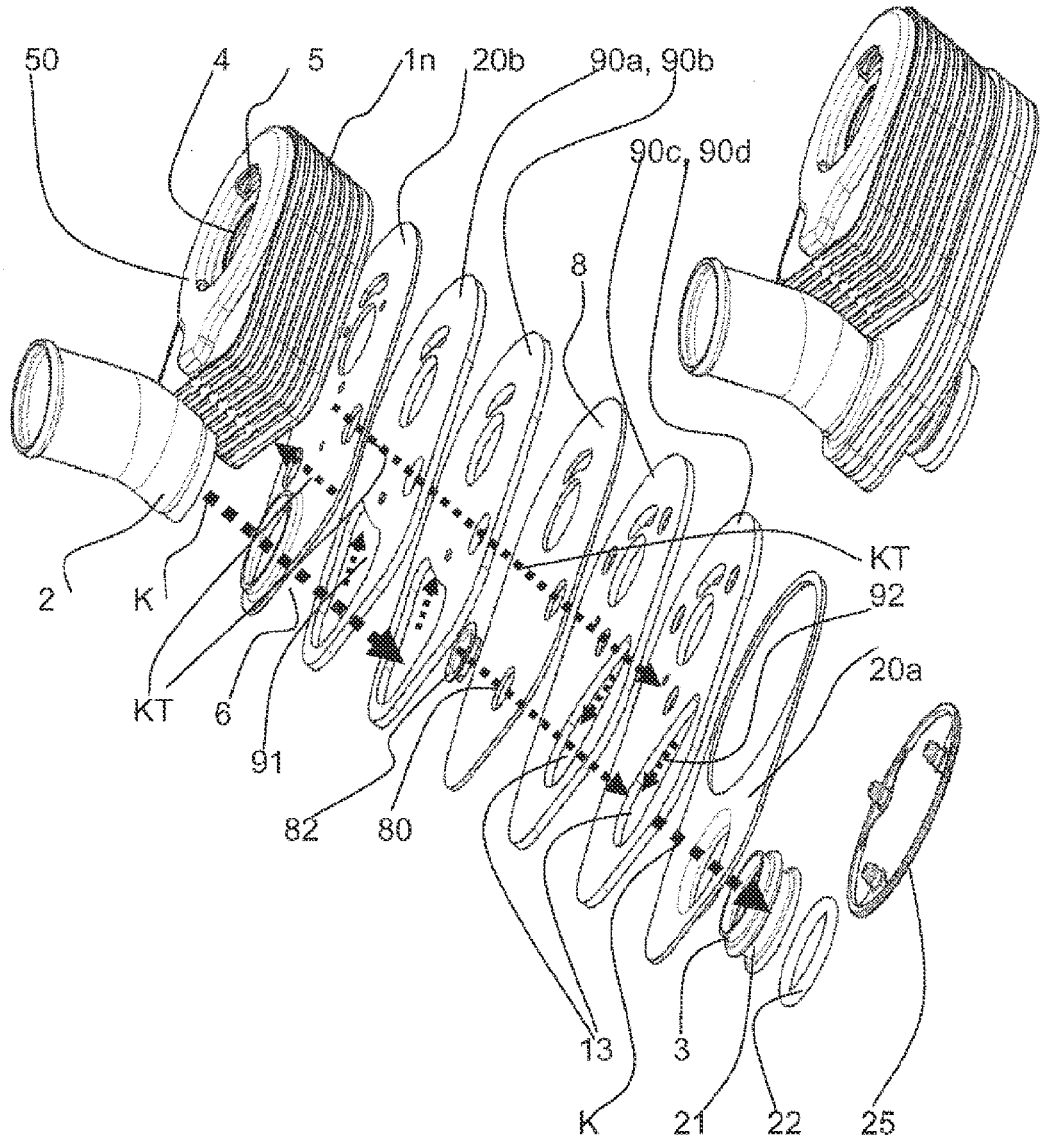
FIG. 1*a* is an exploded view of an embodiment of the invention.
FIG. 1*b* is a perspective view of the embodiment of FIG. 1*a*.

FIGS. 1*a*, 1*b* and 6*a*, 6*b* show a heat exchanger unit which has heat exchanger ducts 10, 11, formed by means of plates 1*n*, for a coolant flow K and for a flow S to be cooled or temperature-controlled and which is provided with corresponding inlets and outlets 2, 3, 4, 5 for the flows. The heat exchanger unit is provided with a coolant inlet chamber 6 from which a coolant partial flow KT comprising approximately 20 to 80 percent of the coolant flow can be branched off, conducted or circulated through the associated heat exchanger ducts 10 and recirculated into or combined with the coolant flow K upstream of the outlet. In the exemplary embodiment shown, the coolant partial flow amounts, on average, to approximately 60 percent of the coolant flow.

In the exemplary embodiments shown, the heat exchanger unit is used as an oil cooler. Situated above the heat exchanger unit is an oil filter through which the oil flows. The uppermost covering plate provides a circular sealing surface 50 for the oil filter.

The branching of the coolant partial flow KT is realized by means of an orifice plate 8 which is arranged between the inlet chamber 6 and an outlet chamber 13. The heat exchanger can be adapted to a certain extent to different usage conditions by simply replacing the orifice plate 8 with another orifice plate with a larger or smaller opening. The rest of the heat exchanger unit may remain unchanged. As mentioned, the orifice plate 8 has at least one orifice opening 80, the opening edge of which is reinforced. The opening edge is provided by means of a plastic coating or by means of a high-grade steel lining. For this purpose, a rubber or plastic collar 82 may be fastened to the opening edge. Alternatively, a collar 82 composed of high-grade steel may also be pressed or cast onto the opening edge. It has been found that, in the case of a flow speed higher than approximately 2 m/s, which may arise in some applications, the orifice plate 8, which like all the other plates 1*n* or individual parts is preferably produced from expediently solder-coated aluminum plates, is subjected to extremely high erosion forces, which should be counteracted in the described way (see FIG. 1, 2, 4 or 8).

The coolant inlet chamber 6 receives the entire coolant flow, for example of a liquid-cooled internal combustion engine.

The outlet chamber 13 or the outlet 3 of the coolant is arranged approximately in line with the inlet 2 of the coolant, as a result of which conveying ducts are not required. The inlet chamber 6 and the outlet chamber 13 and the orifice opening 80 of the orifice plate 8 are situated to the side of, that is to say relatively closely adjacent to, the plate stack 1 or the stack of plate pairs.

The unit also comprises a plate as a lower port plate 20*a* with an opening, on the edge of which is integrally formed a connecting piece 21. This is shown for example in FIGS. 2*a* and 2*b*. The integral forming of the connecting piece 21 reduces the number of individual parts. The connecting piece 21 is created by drawing and rolling in the opening edge in order to provide a sealing groove in which a sealing ring 22 is situated. It is thereby made possible for the connecting piece 21 to be sealingly plugged into a system-side flow opening. In the exemplary embodiments shown, by means of said connecting piece 21, the coolant flow K is recirculated together with the coolant partial flow KT into the coolant circuit. In the other figures, the connecting piece 21 has been inserted as a separate part which is soldered into the opening of the port plate 20*a*. Also provided is a further plate as an upper port plate 20*b*, which has the inlet connecting piece 2. The above description may likewise apply with regard to the design of said upper port plate, even though in the drawings the connecting piece 2 is illustrated as a separate part.

Figure 6A:
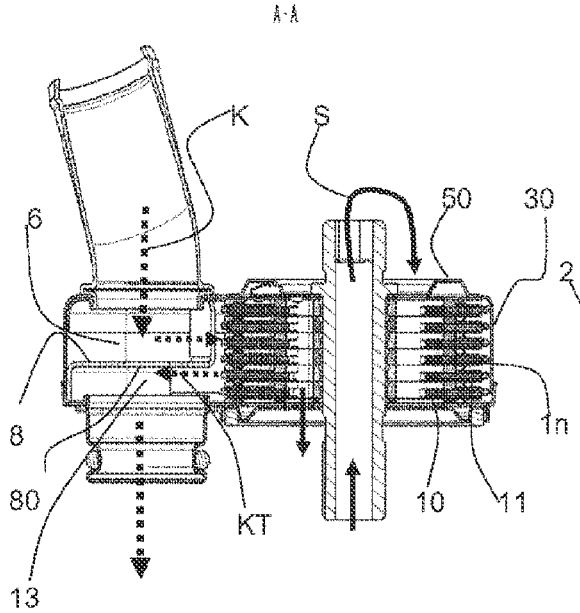
FIG. 6a Prior Art
FIGS. 6*a* and 6*b* show a prior art heat exchanger unit.
Figure 6B:
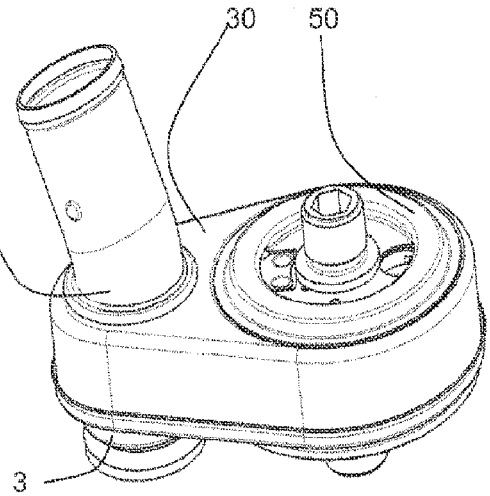
FIG.6b Prior Art

The prior art heat exchanger unit according to FIGS. 6*a* and 6*b* has a housing 30 on which the coolant inlet 2 and the coolant outlet 3 are arranged, In this case, the associated heat exchanger ducts 10 extend in each case between two plate pairs, wherein the flow to be cooled or temperature-controllecl flows in the individual plate pairs 11. An orifice plate 8 with an opening 80 is situated between the inlet chamber 6 and the outlet chamber 13 for the coolant. As can be seen from FIG. 6*a*, the orifice plate 8 in this embodiment is not completely planar like a plate, but rather has matched bent portions such that it can be correspondingly fastened in the chamber 6. Corresponding arrows, the dotted arrows for the flow of the coolant K and the solid arrows for the oil S, have also been plotted here and illustrate the description above. The coolant partial. flow KT enters into the associated heat exchanger ducts 10, which in this exemplary embodiment are illustrated as laterally open ducts between in each case two plate pairs, flows through said ducts and enters into the outlet chamber 13 below the orifice plate 8, before departing the heat exchanger unit in the coolant flow K via the outlet 3. In this embodiment, too, the inlet and the outlet are situated laterally adjacent to the plates 1*n*.

Figure 5A:
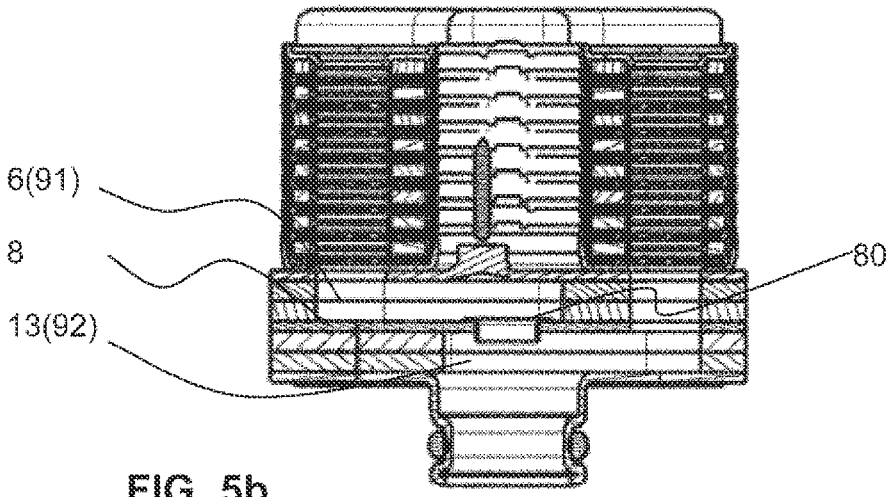
FIGS. 5*a* and 5*b* show another section AB.
Figure 5B:
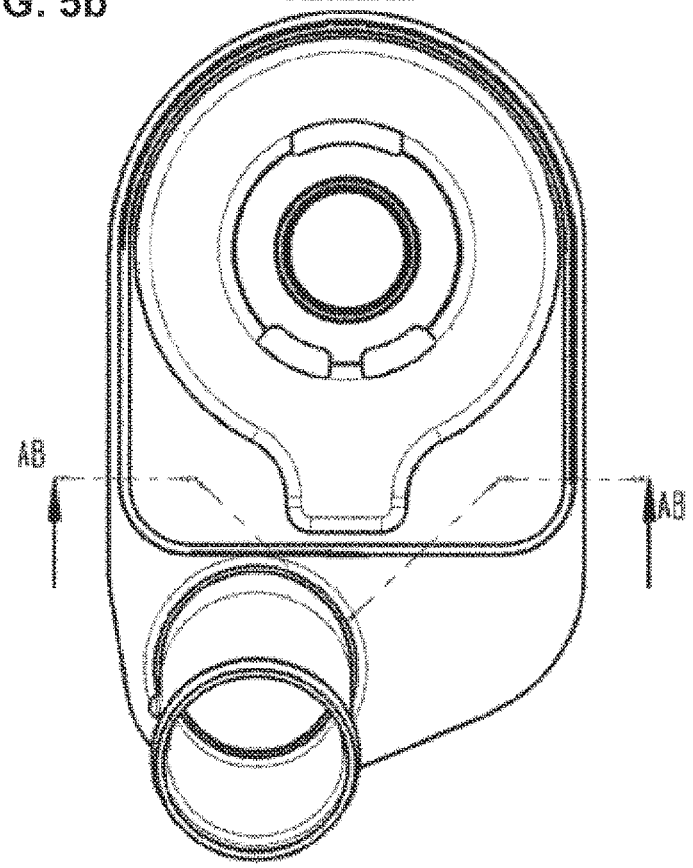

The unit is formed without a housing 30, as is shown in the rest of the figures. Here, the associated heat exchanger ducts 10 for the coolant partial flow KT and the heat exchanger ducts 11 for the flow to be cooled or temperature-controlled are formed from stacked trough-shaped plates 1*n*, which have an obliquely protruding edge at which the plates 1*n* bear against one another and which can be connected by means of soldering. The plate stack 1 also has at least one orifice plate 8 and an adapter plate 90. The coolant inlet chamber 6 and the coolant outlet chamber 13, which is partially separated by the orifice plate 8, are formed in the adapter plate 90. Also, proceeding from the coolant inlet chamber 6, there is arranged at least one supply duct 91 to a distributor chamber for the coolant partial flow KT, which distributor chamber is formed from openings in the plates and extends through the plate stack. The distributor chamber is flow-connected to the associated heat exchanger ducts 10 and to a collecting chamber formed in the same way. In this context, "in the same way" means that the plates 1*n* have further openings which provide the collecting chamber in the plate stack 1. Furthermore, proceeding from the collecting chamber, there is provided at least one discharge duct 92 which leads to the outlet chamber 13. The outlet chamber 13 is also formed in the adapter plate 90. The size of the inlet chamber 6, of the outlet chamber 13 and of the inflow and outflow duct 91, 92 can be adapted by layering a plurality of adapter plates 90*a*, 90*b*, 90*c* and 90*d*. The adapter plate(s) is/are soldered to the plate stack, which also applies to the entire unit, as can be seen from the figures (for example FIG. 5*a*). In the exemplary embodiment, the orifice plate 8 is situated between adapter plates 90*a* and 90*b* on one side and 90*c* and 90*d* on the other side.

Figure 2A:
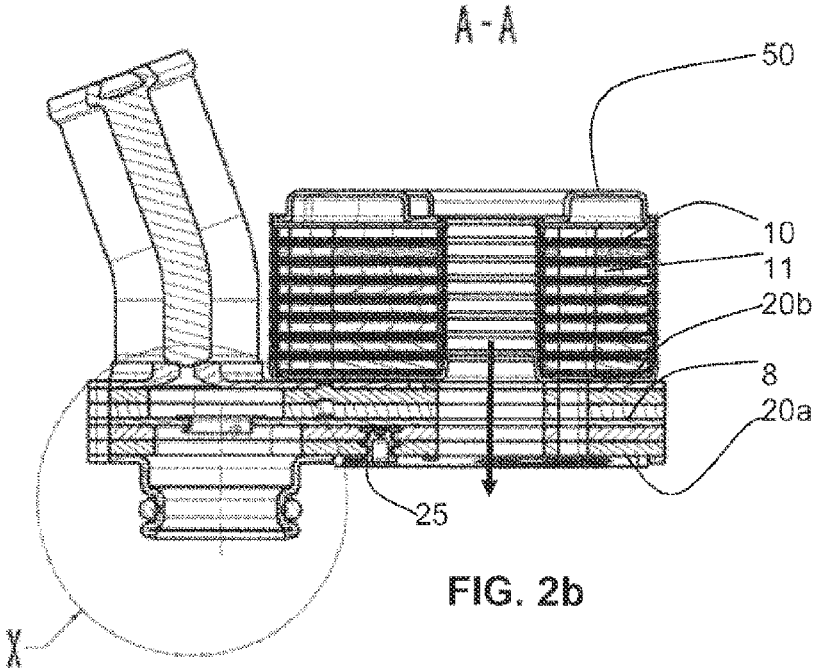
FIGS. 2*a* and 2*b* show sections through the heat exchanger unit of the embodiment of FIGS. 1*a* and 1*b*.
Figure 2B:
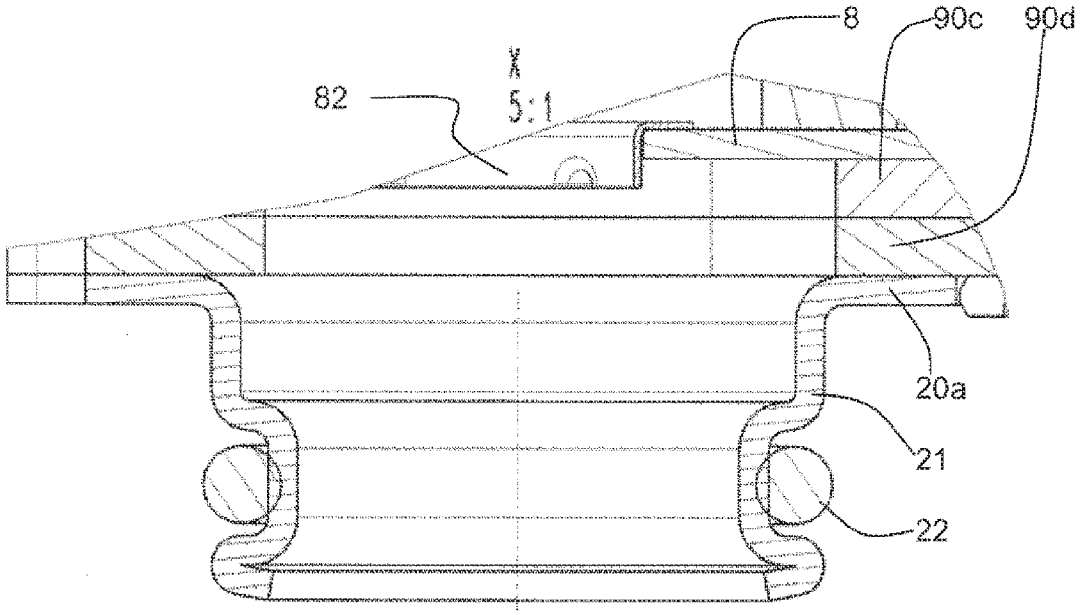
Figure 3:
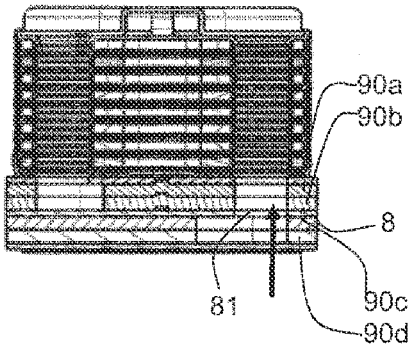
FIG. 3 shows another section through the heat exchanger unit.
Figure 4A:
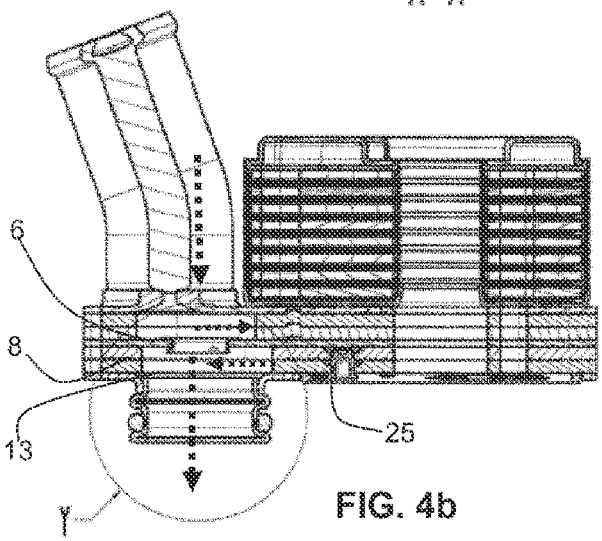
FIGS. 4*a* and 4*b* show a section similar to FIG. 2*a*.
Figure 4B:
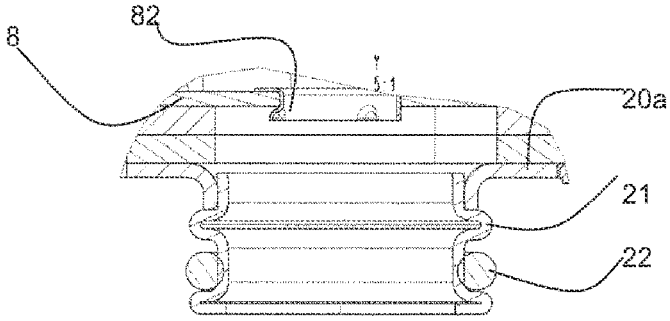

FIGS. 1*a*, 2*a* and 4*a* also show an annular seal 25 which, at the underside of the unit, can be plugged with projections into corresponding openings in order to be securely held therein and in order to make the heat exchanger unit ready for operation.

Figure 7A:
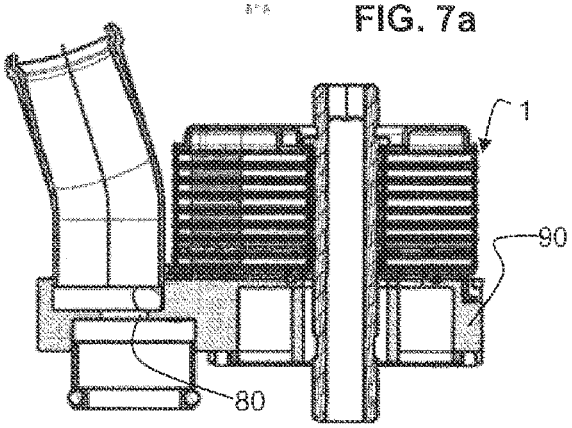
FIGS. 7*a*, 7*b* and 7*c* show a third embodiment.
Figure 7B:
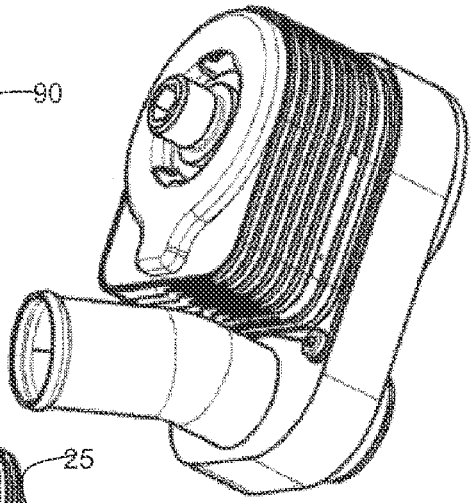
Figure 7C:
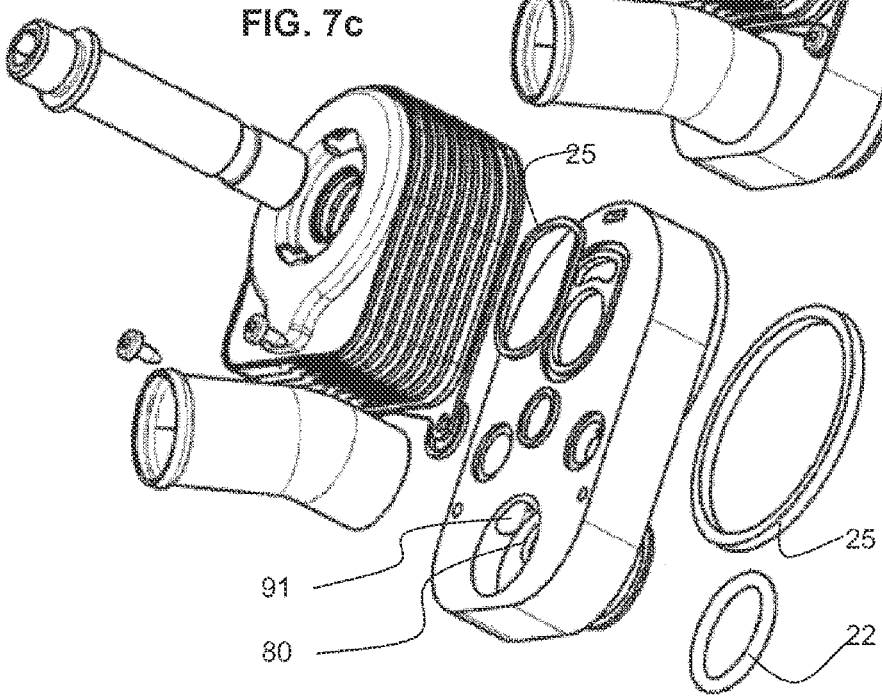
Figure 8:
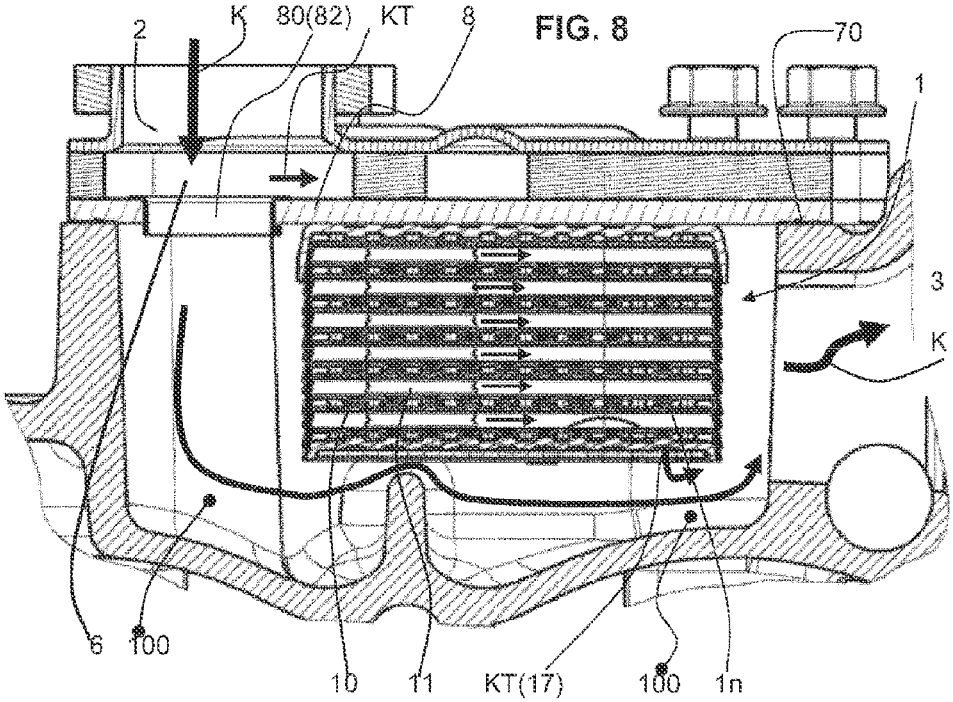
FIG. 8 shows a section through a heat exchanger unit according to a further exemplary embodiment.

In a further embodiment of the invention shown in FIGS. 7*a*, 7*b* and 7*c*, the adapter plate 90 is replaced with a port adapter 90, which is for example cast and in which the described functions are integrated. In such embodiments, the port adapter 90 is then fastened to the soldered plate stack mechanically with the insertion of a seal. In this embodiment, too, a discharge duct 92 is situated below the orifice opening 80, but said discharge duct 92 is not visible in the illustrations. In this embodiment, the heat exchanger plates 1*n* may be of identical design to the embodiment according to FIG. 1.

FIGS. 8-12 show a further heat exchanger unit of the housingless construction, which heat exchanger unit has heat exchanger ducts 10, 11, formed by means of plates 1*n* in a plate stack 1, for a coolant flow K (solid arrows) and for a flow S to be cooled or temperature-controlled (dashed arrows), and which heat exchanger unit is provided with corresponding inlets and outlets 2, 3, 4, 5 for the flows. The heat exchanger unit has been provided with a coolant inlet chamber 6 from which a coolant partial flow KT comprising approximately 50% of the coolant flow can be branched, conducted through the associated heat exchanger ducts 11 and recirculated into the coolant flow K. The coolant partial flow KT exits the plate stack 1 on the side opposite the inlet 2, through an opening, at the collecting duct 17, in the plates 1*n* (see also FIG. 12). There, the coolant partial flow KT enters into a chamber 100 and merges preferably already in the chamber 100 with the coolant flow K flowing through the chamber 100 and around the plate stack 1. The entire coolant flow K leaves the chamber 100 via an outlet 3 in the engine casing, before being supplied for example to a radiator for re-cooling.

In this exemplary embodiment, too, an orifice plate 8 is used. Here, too, the coolant inlet chamber 6 receives the entire coolant flow, for example of a liquid-cooled internal combustion engine.

Figure 9:
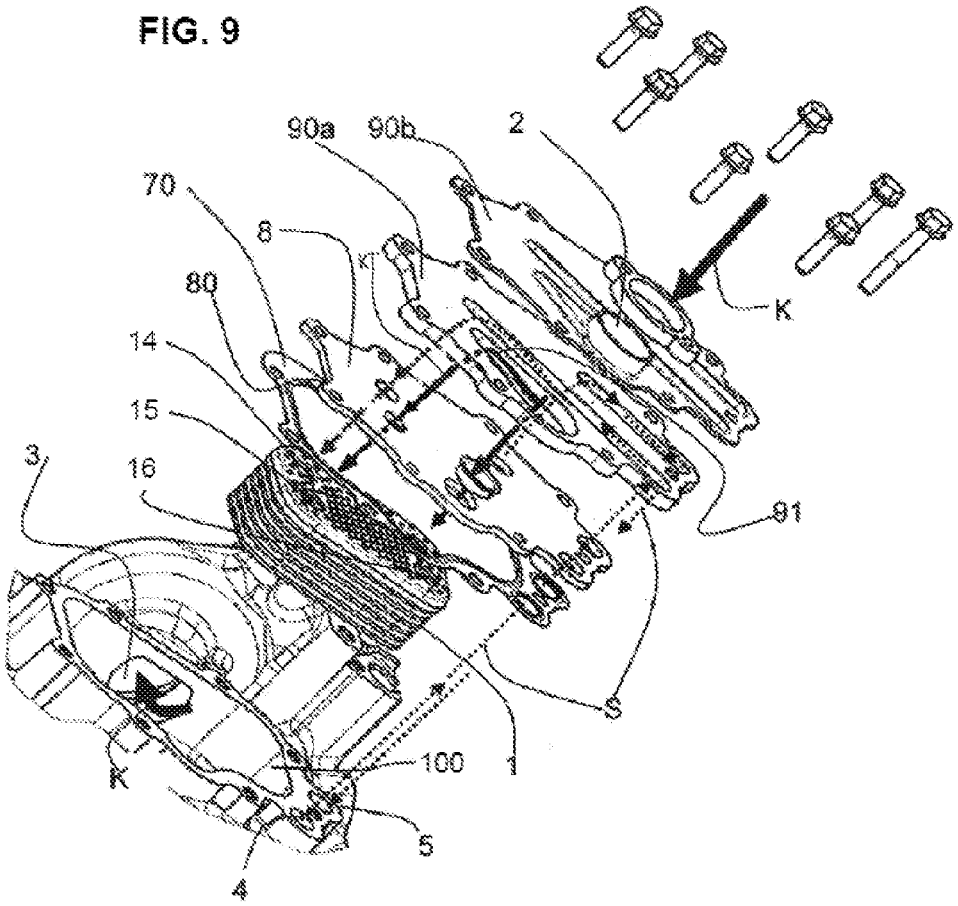
FIG. 9 shows an exploded illustration of the heat exchanger unit from FIG. 8.
Figure 10:
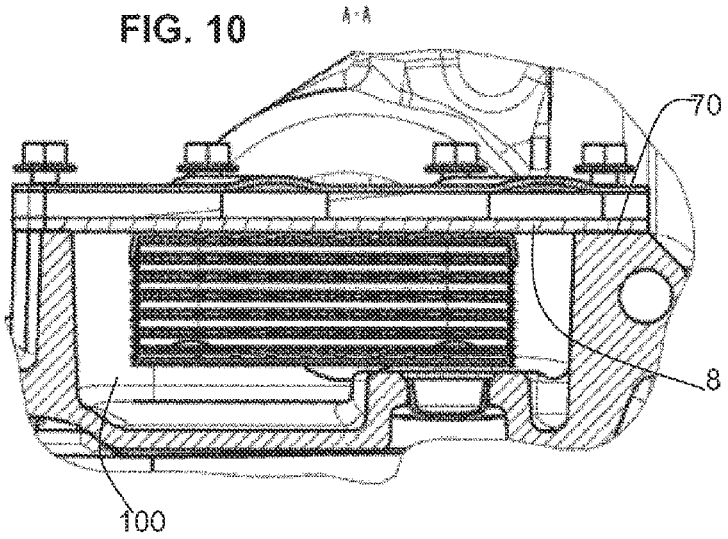
FIG. 10 shows another section through the heat exchanger unit from FIG. 8.

The plate stack 1 has been arranged in the chamber 100 such that the obliquely protruding edges of the plates 1*n* point into the chamber 100. The orifice plate 8 and an adapter plate 90 which closes the chamber 100 are accordingly arranged on that side of the plate stack 1 from which the oblique edges point away. Furthermore, in this exemplary embodiment, too, the plates 1*n* have four openings which, in the stack 1, form four corresponding collecting and distributor ducts for the two media flows. In FIG. 9, the collecting ducts 16, 17 and distributor ducts 14, 15 are formed by means of the plate openings and are partially visible. If a third medium flow is to participate in the heat exchange, six openings would correspondingly be provided in the plates 1*n*.

The illustrated soldered plate stack 1 also has the orifice plate 8 and two adapter plates 90*a*, 90*b*.

Furthermore, proceeding from the coolant inlet chamber 6, there is arranged at least one supply duct 91 to said distributor duct 15, which extends through the plate stack 1, for the coolant partial flow KT. The distributor duct 15 is flow-connected to the associated heat exchanger ducts 11 and to the collecting duct 17 which is formed in the same way.

The oil passes out of the engine casing via an inlet 4, flows through a duct in the adapter plate 90 to its provided inlet location (at distributor duct 14) into the plate stack 1, and flows through said heat exchanger ducts 10 in the plate stack 1 before thereafter passing via the associated collecting duct 16 and through a further duct in the adapter plate 90 to the outlet 5, that is to say back into the engine housing (FIG. 9). As can be seen, the oil thus enters and exits at the same side of the plate stack 1.

Figure 11:
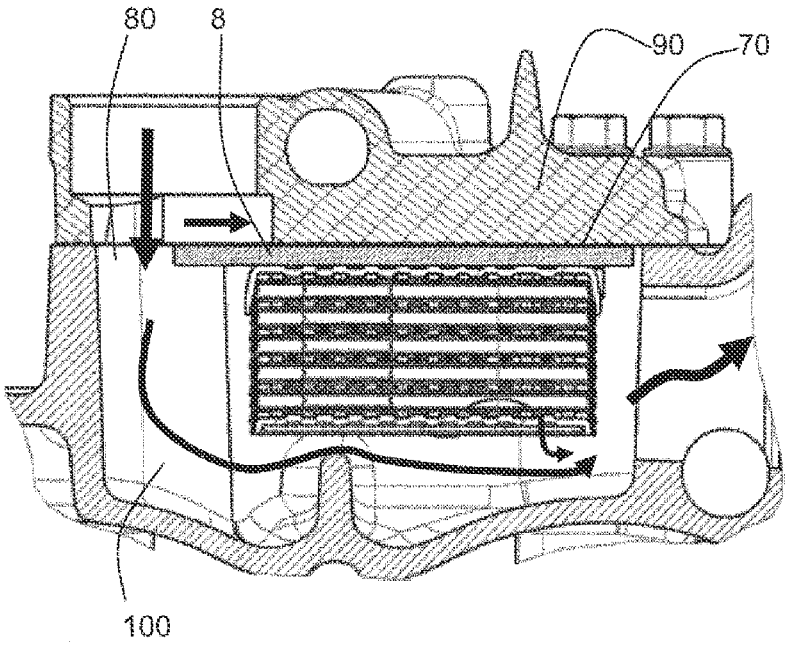
FIG. 11 is a cross-sectional view of another embodiment of a heat exchanger unit.
Figure 12:
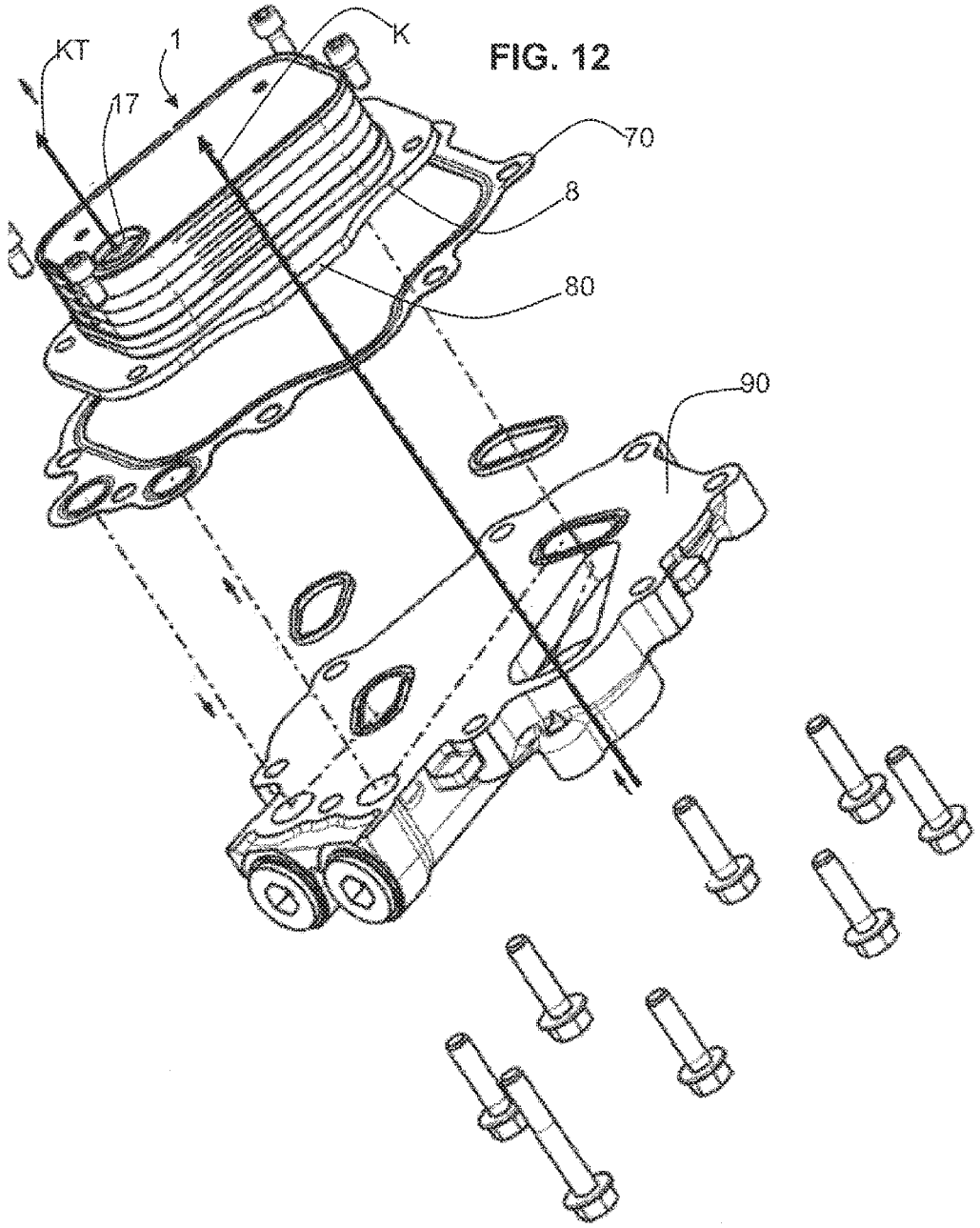
FIG. 12 is an exploded view of the heat exchanger unit of FIG. 11.

In a further embodiment of the invention shown in FIGS. 11 and 12, the adapter plate 90*a*, 90*b* is replaced by a port adapter 90, which is for example cast and in which the described functions are integrated. In such embodiments, the port adapter 90 is then fastened mechanically to the soldered plate stack 1 with the insertion of an annular seal 70. A seal can also be provided in the direction of the recess in the engine housing. As a further difference in relation to the embodiments described above, in this case the orifice opening 80 has been formed not as a passage hole through the orifice plate but rather as a cut-away portion on the orifice plate 8. The cut-away portion provides the orifice opening 80, since there is a corresponding difference in size between the recess in the engine housing (chamber 100) and the orifice plate 8. As a result, in FIG. 11, the seal 70 is situated above the orifice plate 8, whereas it can be seen from FIG. 8 and FIG. 9 that the seal 70 is arranged below the orifice plate 8. On account of some reference signs not used in FIG. 11, reference is made to FIG. 8.

In the illustration of FIG. 12, the engine casing chamber 100 has been omitted, even though it is in fact present.

In these embodiments, to fasten the plate-type heat exchanger 1 in the chamber 100, corresponding fastening means in the form of screws or the like, including corresponding bores through the adapter plate 90 and the orifice plate 8, are provided and schematically depicted.

What is claimed is:

1. A heat exchanger unit for exchanging heat between a first flow and a second flow, comprising:

an engine chamber having a first flow outlet; and an adapter plate extending around and enclosing an opening of the engine chamber, wherein the adapter plate has a first flow inlet fully receiving the first flow and a first flow inlet chamber;

an orifice plate having a first orifice opening and a second orifice opening;

a plate stack attached to the orifice plate such that the plate stack is disposed within the engine chamber, including;

a plurality of plates, wherein adjacent plates are joined along their peripheries to form a plurality of first heat exchanger ducts and a plurality of second heat exchanger ducts, the plurality of first heat exchanger ducts formed by the plurality of plates connected by a first collecting duct and a first distributor duct formed in the plates, and wherein the first distributor duct is aligned with the second orifice opening and the first collecting duct includes a first collecting duct opening from which the partial first flow exits the plate stack, and the plurality of second heat exchanger ducts formed by the plurality of plates, and connected by a second collecting duct and a second distributor duct formed in the plates; and whereby the first flow inlet chamber fully receives the first flow from the first flow inlet and branches the first flow partially to the first orifice opening into the engine chamber and partially to the second orifice opening into the plate stack such that part of the first flow contacts an outer surface of the plate stack in the engine chamber while another part of the first flow passes through the plurality of first heat exchanger ducts within the plate stack wherein the first flow merges upstream of the first flow outlet and the first flow outlet fully receives the first flow.

2. The heat exchanger of claim 1, wherein first flow inlet and the first flow inlet chamber conduct at least a portion of the first flow in the same direction.

3. The heat exchanger of claim 1, wherein the first flow inlet directs the first flow in the direction of the plate stack.

4. The heat exchanger of claim 1, wherein the first collecting duct opens to the space outside of the plate stack and is connected fluidically with the periphery of the plate stack.

5. The heat exchanger of claim 1, wherein the first collecting duct opening is fluidically connected with the first flow inlet chamber.

6. The heat exchanger of claim 1, wherein the first flow inlet chamber extends from the first flow inlet to the first distributor duct, and wherein the portion of the first flow inlet chamber adjacent to the first flow inlet is larger than the portion of the first flow inlet chamber adjacent to the first distributor duct.

7. The heat exchanger of claim 1, wherein the first flow inlet chamber is in line with the first distributor duct and is in line with the first flow inlet.

8. A plate-type heat exchanger extending into an engine chamber and enclosing the chamber to exchange heat between a first coolant flow and a second flow to be cooled comprising:

an adapter plate extending around and enclosing an opening of the engine chamber, wherein the adapter plate has a first flow inlet and a first flow inlet chamber and the engine chamber has a first flow outlet;

an orifice plate having a first orifice opening and a second orifice opening; and a plate stack attached to the orifice plate such that the plate stack is disposed within the engine chamber, the plate stack further including, a plurality of plates, wherein adjacent plates are joined along their peripheries to form a plurality of first heat exchanger ducts and a plurality of second heat exchanger ducts, wherein the first flow inlet chamber receives the entire first coolant flow from the first flow inlet and directs a first part of the first coolant flow to the first orifice opening into the engine chamber and a second part of the first coolant flow to the second orifice opening into the plurality of first heat exchanger ducts in the plate stack, and whereby the first part of coolant flow contacts an outer surface of the plate stack in the engine chamber while the second part of the first coolant flow passes through the plurality of first heat exchanger ducts within the plate stack wherein the first coolant flow merges upstream of the first flow outlet and the first flow outlet fully receives the first flow.

9. A heat exchanger system for exchanging heat between a coolant flow and a second fluid to be cooled comprising:

an engine chamber including a coolant flow outlet; and an adapter plate extending around and enclosing an opening of the engine chamber, wherein the adapter plate has a coolant flow inlet and a coolant flow inlet chamber;

an orifice plate having a first orifice opening and a second orifice opening;

a plate stack attached to the orifice plate such that the plate stack is disposed within the engine chamber including, a plurality of plates, wherein adjacent plates are joined along their peripheries to form a plurality of first heat exchanger ducts and a plurality of second heat exchanger ducts, wherein the coolant flow inlet chamber receives the entire coolant flow from the coolant flow inlet and branches the coolant flow partially to the first orifice opening into the engine chamber and partially to the second orifice opening into the plate stack such that part of coolant flow contacts an outer surface of the plate stack in the engine chamber while another part of the coolant flow passes through the plurality of first heat exchanger ducts within the plate stack, and wherein the partial coolant flows merge upstream of the coolant flow outlet and the coolant flow outlet receives the entire coolant flow.

10. The heat exchanger of claim 1, wherein the periphery of the plate stack is defined by edges of the plurality of plates, and wherein the edges of adjacent plates connect.

11. The heat exchanger of claim 1, wherein the first orifice opening includes an edge reinforcement covering the edges of the first orifice opening, wherein the first flow inlet chamber extends between the first flow inlet and the first orifice opening.

12. The heat exchanger of claim 11, wherein the edge reinforcement is one of a plastic coating, a rubber collar, a plastic collar, or a metal collar.

13. The heat exchanger unit of claim 8, wherein the plurality of plates are stacked together and have trough-shaped plates having edges, and wherein the edges of the trough-shaped plates point into the engine chamber.

14. The heat exchanger of claim 8, wherein the first orifice opening includes an edge reinforcement covering the edges of the first orifice opening.

15. The heat exchanger of claim 14, wherein the edge reinforcement is one of a plastic coating, a rubber collar, a plastic collar, or a high-grade steel collar.

16. The heat exchanger of claim 8, wherein the first orifice opening is in-line with the first flow inlet.

17. The heat exchanger of claim 8, wherein the first orifice opening is disposed between the first flow inlet chamber and the engine chamber.

18. The heat exchanger of claim 9, wherein the plurality of first heat exchanger ducts are fluidly connected by a first collecting duct having an exit and wherein the exit of the first collecting duct is fluidly connected to both the coolant flow inlet chamber and the coolant flow outlet on the outside of the plate stack fluidly separated from the first heat exchanger ducts by the exit of the first collecting duct.

* * * * *